US010257889B2

(12) United States Patent
Huang et al.

(10) Patent No.: US 10,257,889 B2
(45) Date of Patent: Apr. 9, 2019

(54) HIGH-FREQUENCY HEATING DEVICE AND METHOD AND APPARATUS FOR CONTROLLING POWER SUPPLY OF THE SAME

(71) Applicants: MIDEA GROUP CO., LTD., Foshan (CN); GUANGDONG MIDEA KITCHEN APPLIANCES MANUFACTURING CO., LTD., Foshan (CN)

(72) Inventors: Bin Huang, Foshan (CN); Xingchao Chen, Foshan (CN); Nianzhong Zheng, Foshan (CN)

(73) Assignees: MIDEA GROUP CO., LTD., Foshan (CN); GUANGDONG MIDEA KITCHEN APPLIANCES MANUFACTURING CO., LTD., Foshan (CN)

( * ) Notice: Subject to any disclaimer, the term of this patent is extended or adjusted under 35 U.S.C. 154(b) by 277 days.

(21) Appl. No.: 14/905,332

(22) PCT Filed: Sep. 13, 2013

(86) PCT No.: PCT/CN2013/083462
§ 371 (c)(1),
(2) Date: Jan. 15, 2016

(87) PCT Pub. No.: WO2015/007014
PCT Pub. Date: Jan. 22, 2015

(65) Prior Publication Data

US 2016/0165669 A1 Jun. 9, 2016

(30) Foreign Application Priority Data

Jul. 17, 2013 (CN) ..... 2013 1 0304343

(51) Int. Cl.
*H05B 6/08* (2006.01)
*H05B 6/04* (2006.01)
*H05B 6/06* (2006.01)

(52) U.S. Cl.
CPC ..... *H05B 6/06* (2013.01)

(58) Field of Classification Search
CPC . H05B 6/04; H05B 6/06; H05B 6/062; H05B 6/065; H05B 6/105; H05B 6/1209;
(Continued)

(56) References Cited

U.S. PATENT DOCUMENTS 4,686,340 A * 8/1987 Fukasawa ..... H05B 6/06 219/664
5,248,866 A 9/1993 Tanaka et al.
(Continued)

FOREIGN PATENT DOCUMENTS

CN 201310962 Y 9/2009
CN 102171919 A 8/2011
(Continued)

OTHER PUBLICATIONS

The Canadian Intellectual Property Office, Office Action for CA Application 2919488, dated Nov. 7, 2016, 3 pages.
(Continued)

*Primary Examiner* — Hung D Nguyen
(74) *Attorney, Agent, or Firm* — Hodgson Russ LLP

(57) ABSTRACT

Disclosed is a method for controlling a power supply of a high-frequency heating device, comprising: controlling a switching element of the high-frequency heating device to operate according to a control signal with a preset duty ratio; detecting a real-time current flowing through the switching element; and if the real-time current is greater than or equal to a preset current reference value, controlling the switching element to turn off, and controlling the switching element to
(Continued)

turn on when a next turn-on window of the control signal comes. The method may reduce a maximum current during an operation of the switching element, thus reducing requirements for the switching element and enabling an effective over-current protection. Further disclosed is an apparatus for controlling a power supply of a high-frequency heating device and a high-frequency heating device with the apparatus for controlling the power supply.

10 Claims, 4 Drawing Sheets

(58) Field of Classification Search
CPC ..... H05B 6/145; H05B 6/66; H05B 6/683; H05B 6/685
USPC ..... 219/660, 661, 663, 664, 668, 715, 716, 219/718, 721, 722, 760, 620
See application file for complete search history.

(56) References Cited

U.S. PATENT DOCUMENTS

| | | | | |
|---|---|---|---|---|
| 6,163,019 | A | 12/2000 | Green et al. | |
| 2003/0155349 | A1* | 8/2003 | Matsuo | H05B 6/06 219/664 |
| 2006/0221528 | A1 | 10/2006 | Li et al. | |
| 2009/0146629 | A1 | 6/2009 | Kim | |

FOREIGN PATENT DOCUMENTS

| | | | |
|---|---|---|---|
| CN | 102177665 | A | 9/2011 |
| CN | 102361524 | A | 2/2012 |
| CN | 102412565 | A | 4/2012 |
| CN | 102647104 | A | 8/2012 |
| CN | 102781130 | A | 11/2012 |
| JP | H09102385 | A | 4/1997 |
| JP | H10335999 | A | 12/1998 |
| JP | 2003295679 | A | 10/2003 |
| JP | 2007188771 | A | 7/2007 |
| JP | 2009064750 | A | 3/2009 |
| KR | 20080087565 | A | 10/2008 |

OTHER PUBLICATIONS

The European Patent Office, Extended European Search Report for EP Application 13889359, dated Mar. 1, 2017, 8 pages.
The Japanese Patent Office, Notification of Reason for Refusal for JP Application 2016526401, dated Jan. 20, 2017, 3 pages.
The Korean Intellectual Property Office, Notification of Reason for Refusal for KR Application 20167002812, dated Feb. 8, 2017, 4 pages.
The State Intellectual Property Office of People's Republic of China, Third Office Action for CN Application 201310304343.2, dated Sep. 19, 2016, 8 pages.
The State Intellectual Property Office of People's Republic of China, Second Office Action for CN Application 201310304343.2, dated Mar. 30, 2016, 8 pages.

* cited by examiner

HIGH-FREQUENCY HEATING DEVICE AND METHOD AND APPARATUS FOR CONTROLLING POWER SUPPLY OF THE SAME

FIELD

The present disclosure generally relates to the field of high-frequency heating technology, and more particularly, to a method for controlling a power supply of a high-frequency heating device, an apparatus for controlling a power supply of a high-frequency heating device and a high-frequency heating device with the apparatus for controlling the power supply.

BACKGROUND

In the power supply of the high-frequency heating device (for example, a microwave oven) with a magnetron as a load, it often needs to change on-off time (a frequency or a duty ratio) of a main switching element, for example, an IGBT (Insulated Gate Bipolar Transistor), so as to regulate an output power of the power supply. A voltage control mode is adopted generally in a conventional way. That is, a circuit is controlled to output a certain pulse width according to a value of an input voltage and a required output power, such that the on-off time of the main switching element is controlled. In principle, the higher the input voltage is, the smaller the turn-on time of the IGBT is; the greater the output power is, the greater the turn-on time of the IGBT is. This control mode is more complicated and strict in a timing sequence of software, and a maximum current cannot be controlled during the whole procedure and there are high requirements for the switching element.

The waveform of the input voltage and the switch waveform of the IGBT in the related art may be shown in FIG. 1. A software adjustment may be performed on the driving of the IGBT by using a sequential control mode. The controller continuously controls the main switching element (for example, IGBT) to turn on and turn off according to a preset on-off program. The whole heating device is turned off and the operation ends if reaching a preset over-current protection voltage. The resource consumption of the controller is bigger and the over-current protection cannot be performed timely in this control mode.

SUMMARY

The present disclosure aims to solve at least one of the above problems.

Accordingly, a first objective of the present disclosure is to provide a method for controlling a power supply of a high-frequency heating device. The method may reduce a maximum current during an operation of the switching element, thus reducing requirements for the switching element and enabling an effective over-current protection.

A second objective of the present disclosure is to provide an apparatus for controlling a power supply of a high-frequency heating device. A third objective of the present disclosure is to provide a high-frequency heating device with the apparatus for controlling the power supply.

In order to achieve above objectives, embodiments of a first aspect of the present disclosure provide a method for controlling a power supply of a high-frequency heating device comprising: controlling a switching element of the high-frequency heating device to operate according to a control signal with a preset duty ratio; detecting a real-time current flowing through the switching element; and if the real-time current is greater than or equal to a preset current reference value, controlling the switching element to turn off, and controlling the switching element to turn on when a next turn-on window of the control signal comes.

With the method for controlling the power supply of the high-frequency heating device according to embodiments of the present disclosure, the cut-off control of the maximum value may be performed on the current flowing through the switching element during each switching period, thereby reducing the maximum current during the operation of the switching element and reducing the requirements for the switching element. Moreover, the over-current protection may be effectively performed because of the preset current reference value, such that elements of the high-frequency heating device may be protected from being damaged. In addition, resources of the controller may be greatly saved, and real-time performance of the over-current protection of the switching device may be enhanced.

In an embodiment of the present disclosure, the method further comprises: if the real-time current is less than the preset current reference value, keeping the switching element turning on until a present turn-on window of the control signal ends, controlling the switching element to turn off when the present turn-on window of the control signal ends, and controlling the switching element to turn on when the next turn-on window of the control signal comes.

The control signal is a PWM signal.

Preferably, the switching element is an IGBT.

In order to achieve above objectives, embodiments of a second aspect of the present disclosure provide an apparatus for controlling a power supply of a high-frequency heating device comprising: a current detecting module, configured to detect a real-time current flowing through a switching element of the high-frequency heating device; and a controlling module, connected with the current detecting module and configured to control the switching element to operate according to a control signal with a preset duty ratio, to control the switching element to turn off if the real-time current is greater than or equal to a preset current reference value, and to control the switching element to turn on when a next turn-on window of the control signal comes.

With the apparatus for controlling the power supply of the high-frequency heating device according to embodiments of the present disclosure, the cut-off control of the maximum value may be performed on the current flowing through the switching element during each switching period, thereby reducing the maximum current during the operation of the switching element and reducing the requirements for the switching element. Moreover, the over-current protection may be effectively performed because of the preset current reference value, such that elements of the high-frequency heating device may be protected from being damaged. In addition, resources of the controller may be greatly saved, and real-time performance of the over-current protection of the switching device may be enhanced.

In an embodiment of the present disclosure, if the real-time current is less than the preset current reference value, the controlling module is further configured to control the switching element to keep turning on until a present turn-on window of the control signal ends, to control the switching element to turn off when the present turn-on window of the control signal ends, and to control the switching element to turn on when the next turn-on window of the control signal comes.

The control signal is a PWM signal.

Preferably, the switching element is an IGBT.

Moreover, in an embodiment of the present disclosure, the apparatus further comprises: a filtering module, connected with the current detecting module and configured to filter the real-time current detected by the current detecting module, thereby filtering interference information.

Specifically, in an embodiment of the present disclosure, the controlling module comprises: a comparing unit, connected with the filtering module and configured to compare the filtered real-time current with the preset current reference value, so as to generate a comparing signal; and a controlling unit, connected with the comparing unit and configured to control the IGBT according to the comparing signal.

The apparatus further comprises: a driving module, connected with the controlling unit and a G electrode of the IGBT respectively and configured to generate a driving signal under a control of the controlling unit, for driving the IGBT to turn on and turn off.

In addition, embodiments of the present disclosure also provide a high-frequency heating device comprising the apparatus for controlling the power supply described above.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

Figure 1:
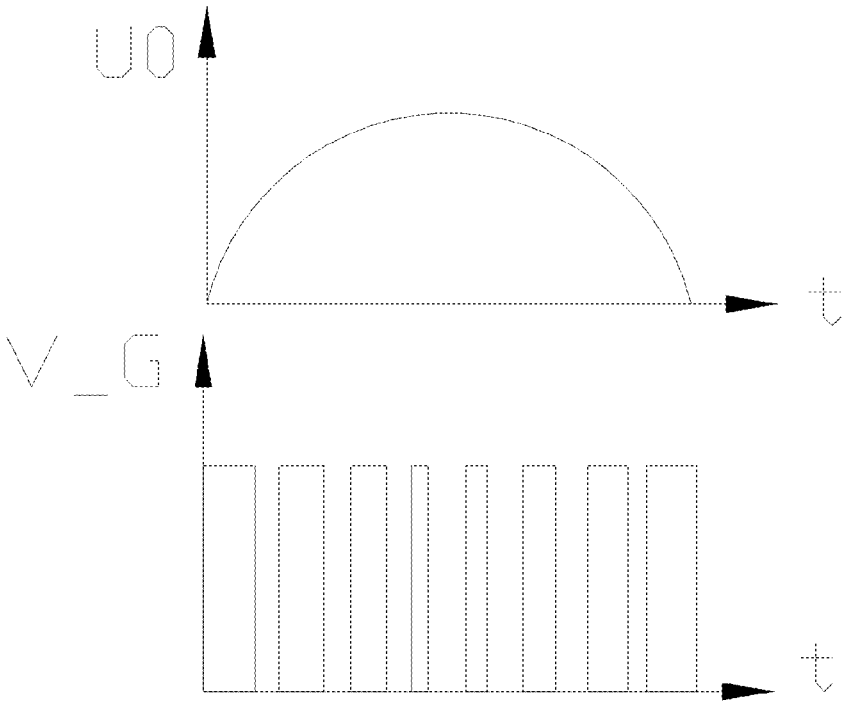
FIG. 1 is a schematic diagram illustrating a waveform of an input voltage and a switch waveform of an IGBT in the related art.

ELEMENTS LIST a current detecting module 101 and a controlling module 102, a switching element 103, a rectifier bridge DB1, an inductor L1 and a capacitor C14, a sampling resistor R25, a capacitor C17, a transformer T1, a resistor R92 and a resistor R8, a capacitor C3, a filtering module 104, a comparing unit 105 and a controlling unit 106, a driving module 107.

DETAILED DESCRIPTION

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied. Moreover, a structure in which a first feature is "on" a second feature may include an embodiment in which the first feature directly contacts the second feature, and may also include an embodiment in which an additional feature is formed between the first feature and the second feature so that the first feature does not directly contact the second feature.

In the description of the present disclosure, it should be noted that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present disclosure.

Referring to the following descriptions and drawings, these and other aspects of the embodiments of the present disclosure will be apparent. In these descriptions and drawings, some specific approaches of the embodiments of the present disclosure are provided, so as to show some ways to perform the principle of the embodiments of the present disclosure, however it should be understood that the embodiment of the present disclosure is not limited thereby. Instead, the embodiments of the present disclosure comprise all the variants, modifications and their equivalents within the spirit and scope of the present disclosure as defined by the claims.

A method for controlling a power supply of a high-frequency heating device, an apparatus for controlling a power supply of a high-frequency heating device and a high-frequency heating device with the apparatus for controlling the power supply provided by embodiments of the present disclosure will be described with reference to the accompanying drawings as follows.

Figure 2:
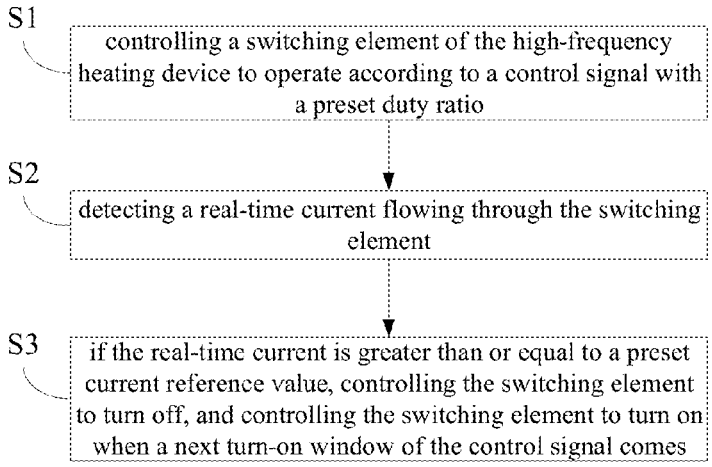
FIG. 2 is a flow chart showing a method for controlling a power supply of a high-frequency heating device according to an embodiment of the present disclosure.

FIG. 2 is a flow chart showing a method for controlling a power supply of a high-frequency heating device according to an embodiment of the present disclosure. As shown in FIG. 2, the method for controlling the power supply of the high-frequency heating device includes following steps.

In S1, a switching element of the high-frequency heating device is controlled to operate according to a control signal with a preset duty ratio.

In an embodiment of the present disclosure, the switching element may be an IGBT.

In S2, a real-time current flowing through the switching element is detected.

In S3, if the real-time current is greater than or equal to a preset current reference value, the switching element is controlled to turn off, and the switching element is controlled to turn on when a next turn-on window of the control signal comes.

The control signal is a PWM (Pulse Width Modulation) signal.

In an embodiment of the present disclosure, the method for controlling the power supply described above further includes steps of: if the real-time current is less than the preset current reference value, keeping the switching element turning on until a present turn-on window of the control signal ends, controlling the switching element to turn off when the present turn-on window of the control signal ends, and controlling the switching element to turn on when the next turn-on window of the control signal comes. It should be noted that, each switching period of the control signal includes a turn-on window and a turn-off window. The switching element is controlled to turn on during the turn-on window of each switching period and to turn off during the turn-off window of each switching period, if the real-time current is less than the preset current reference value.

In other words, a current control mode is adopted by the method for controlling the power supply of the high-frequency heating device according to the present disclosure. When the current flowing through the switching element (for example, the IGBT) does not reach the preset current reference value, the control circuit controls the on/off time of the switching element (for example, the IGBT) according to the input voltage and the required output power, which is similar to the voltage control mode. The IGBT is turned on and off under the control of the control signal with the preset duty ratio output by the control circuit. However, when the current of the switching element (for example, the IGBT) reaches the preset current reference value, the switching element (for example, the IGBT) will be turned off rapidly (ahead of the preset off time).

That is, in the current control mode, the turning off of the switching element is controlled by following two conditions: 1, whether the current of the IGBT reaches the preset current reference value; 2, whether the pulse width of the PWM signal reaches the preset driving pulse width (i.e. the maximum pulse width). The IGBT is controlled to turn off as long as one of the above conditions is satisfied, that is, 1 or 2 is satisfied.

The specific operation procedure may be divided into the following stages: first, the IGBT is controlled to turn on, and at this stage, the current flowing through the IGBT gradually increases; next, the controller judges whether the current of the IGBT reaches the preset current reference value (for example, a preset maximum value) or whether the pulse width of the PWM signal controlling the IGBT reaches the maximum value of the turning-on pulse width. If one of the above conditions is satisfied, the IGBT is controlled to turn off and the current flowing through the IGBT gradually decreases.

Figure 3:
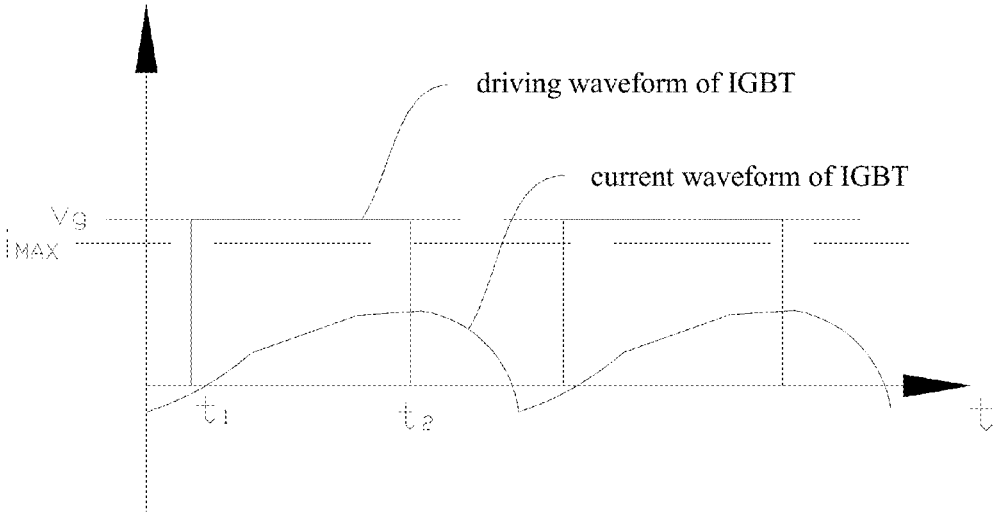
FIG. 3 is a schematic diagram illustrating a driving waveform and a current waveform of an IGBT when a real-time current of the IGBT does not reach a preset current reference value.
Figure 4:
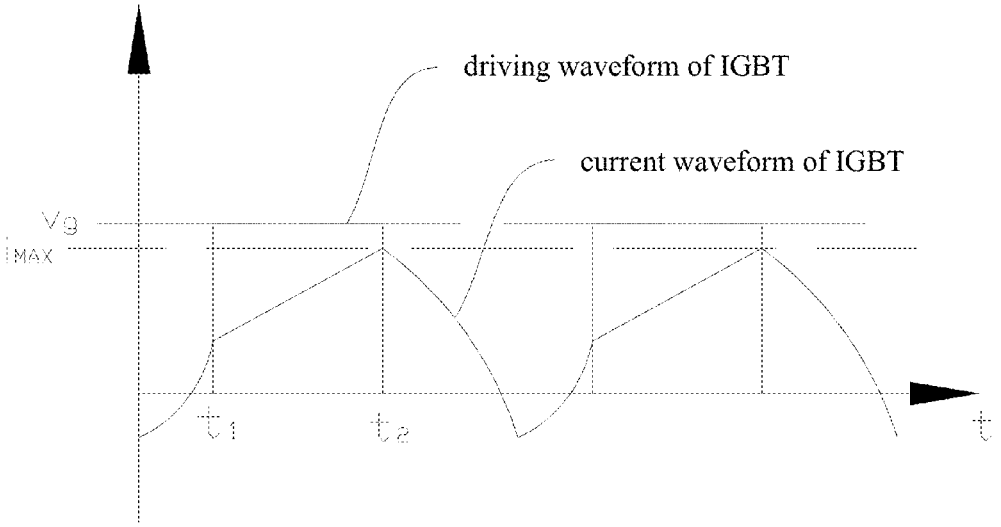
FIG. 4 is a schematic diagram illustrating a driving waveform and a current waveform of an IGBT when a real-time current of the IGBT reaches a preset current reference value.

As shown in FIG. 3, the driving waveform Vg of the IGBT operates in accordance with the preset maximum pulse width, if the preset time for turning off the IGBT by the control circuit comes, but the current flowing through the IGBT does not reach the preset current reference value $i_{MAX}$. As shown in FIG. 3 or FIG. 4, between time T1 and time T2, the control circuit outputs a high level signal to a G electrode of the IGBT. When the current of the IGBT reaches the preset current reference value $i_{MAX}$, the driving waveform Vg of the IGBT changes to a low level signal at the point of reaching the preset current reference value regardless of whether the driving pulse width of the PWM signal controlling the IGBT ends, as shown in FIG. 4.

Figure 5:
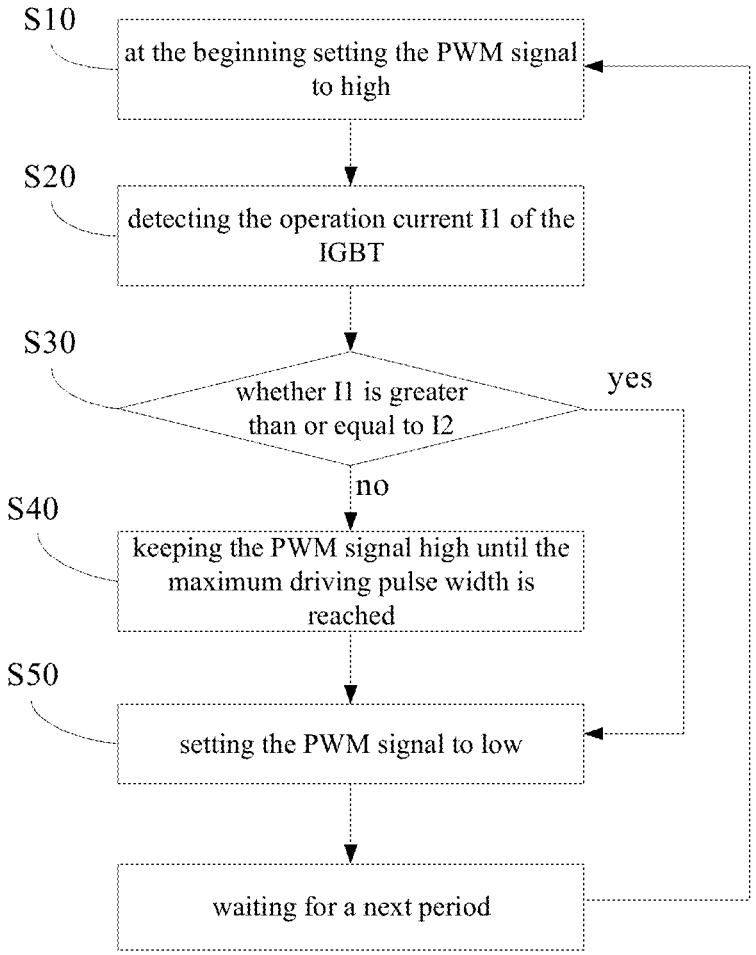
FIG. 5 is a flow chart showing a method for controlling a power supply of a high-frequency heating device according to a specific embodiment of the present disclosure.

In a specific embodiment of the present disclosure, as shown in FIG. 5, the method for controlling the power supply of the high-frequency heating device described above may include the following steps.

In S10, the power supply is started. At the beginning, the PWM signal is set to high, i.e. the high level signal is output, and the IGBT is controlled to turn on.

In S20, the operation current I1 of the IGBT is detected, i.e. the current flowing through the IGBT is detected.

In S30, I1 is compared with the preset current reference value I2 to determine whether I1 is greater than or equal to I2. If I1 is less than I2, step S40 is executed; if I1 is greater than or equal to I2, step S50 is executed.

In S40, the PWM signal keeps high until the maximum driving pulse width is reached, and then step S50 is executed.

In S50, the PWM signal is set to low, i.e. the low level signal is output, and the IGBT is controlled to turn off, and then the PWM signal is set to high when the next period comes (i.e. the next turn-on window of the control signal comes), i.e. step S10 is returned to.

In conclusion, compared with the conventional voltage control mode, the method for controlling the power supply of the high-frequency heating device according to the preset disclosure has following advantages. Firstly, since the cut-off control of the maximum value is performed on the current of the IGBT during each switching period, the transient maximum value of the current is smaller while the effective value of the current is constant, so that the IGBT may adopt a product with a smaller rated current. Secondly, since the maximum current is smaller, the primary back electromotive force of the transformer of the high-frequency heating device becomes smaller and the maximum voltage of the connected drain electrode of the IGBT will be smaller, so that the IGBT may adopt a product with a smaller rated voltage. Again, the transformer is less prone to saturation since the maximum current is smaller, so that the volume of the magnetic core of the transformer may be smaller, thereby reducing cost.

With the method for controlling the power supply of the high-frequency heating device according to embodiments of the present disclosure, the cut-off control of the maximum value may be performed on the current flowing through the switching element during each switching period, thereby reducing the maximum current during the operation of the switching element and reducing the requirements for the switching element. Moreover, the over-current protection may be effectively performed because of the preset current reference value, such that elements of the high-frequency heating device may be protected from being damaged. In addition, resources of the controller may be greatly saved, and real-time performance of the over-current protection of the switching device may be enhanced. Furthermore, the control method is simple and reliable.

Figure 6:
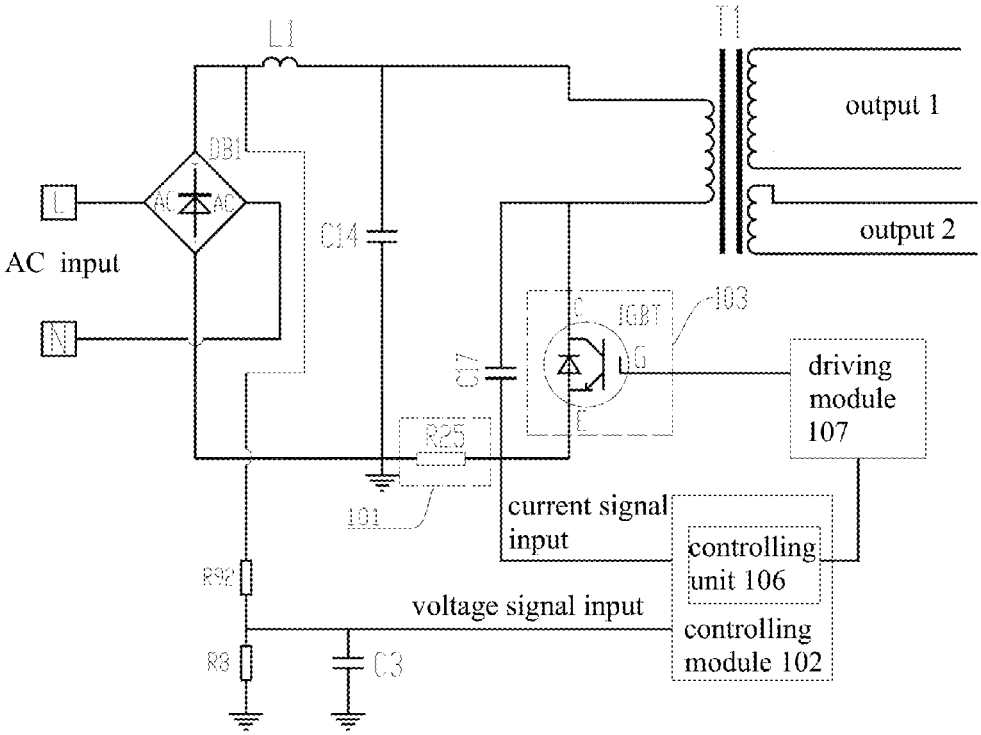
FIG. 6 is a circuit diagram illustrating an apparatus for controlling a power supply of a high-frequency heating device according to an embodiment of the present disclosure.

FIG. 6 is a circuit diagram illustrating an apparatus for controlling a power supply of a high-frequency heating device according to an embodiment of the present disclosure. As shown in FIG. 6, the apparatus for controlling the power supply of the high-frequency heating device includes a current detecting module 101 and controlling module 102.

The current detecting module 101 is configured to detect a real-time current flowing through a switching element 103 of the high-frequency heating device. The switching element 103 may be an IGBT.

The controlling module 102 is connected with the current detecting module 101 and configured to control the switching element 103 to operate according to a control signal with a preset duty ratio, to control the switching element 103 to turn off if the real-time current is greater than or equal to a preset current reference value, and to control the switching element 103 to turn on when a next turn-on window of the control signal comes.

In an embodiment of the present disclosure, if the real-time current is less than the preset current reference value, the controlling module 102 continues to output the high level control signal, controls the switching element 103 to keep turning on until the pulse width of the control signal reaches the maximum pulse width (i.e., the present turn-on window of the control signal ends), controls the switching element 103 to turn off when the present turn-on window of the control signal ends and controls the switching element 103 to turn on when the next turn-on window of the control signal comes. It should be noted that, each switching period of the control signal includes a turn-on window and a turn-off window. The switching element is controlled to turn on during the turn-on window of each switching period and to turn off during the turn-off window of each switching period, if the real-time current is less than the preset current reference value.

As shown in FIG. 6, input terminals L, N of the AC electric supply are connected with the rectifier bridge DB1, and the AC electric supply is rectified into a direct current supply U through the rectifier bridge DB1, and then the direct current supply U may be filtered by the LC filtering circuit consisting of an inductor L1 and a capacitor C14. The current detecting module 101 may be a sampling resistor R25. A first terminal of the sampling resistor R25 is grounded, and a second terminal of the sampling resistor R25 is connected with an E electrode of the IGBT. A capacitor C17 is connected between a C electrode and the E electrode of the IGBT in parallel. The capacitor C17 is connected with a primary winding of a transformer T1 in series to form a resonant circuit. The current signal input terminal of the controlling module 102 is connected with the second terminal of the sampling resistor R25. The voltage signal input terminal of the controlling module 102 is connected with a node between a resistor R92 and resistor R8. A first terminal of the resistor R92 is connected between the rectifier bridge DB1 and the inductor L1, a second terminal of the resistor R92 is connected with a first terminal of the resistor R8, and a second terminal of the resistor R8 is grounded. The node between the resistor R92 and the resistor R8 is also connected with a first terminal of a capacitor C3, and a second terminal of the capacitor C3 is grounded.

Figure 7:
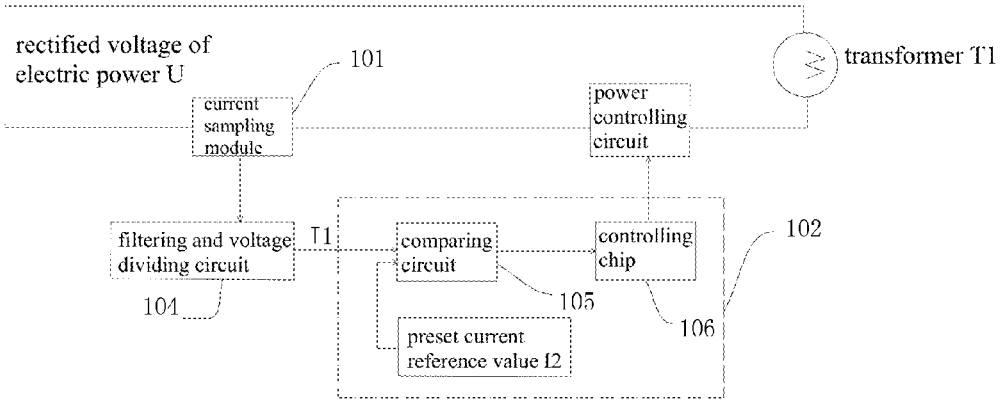
FIG. 7 is a schematic diagram illustrating an apparatus for controlling a power supply of a high-frequency heating device according to an embodiment of the present disclosure.

In an embodiment of the present disclosure, as shown in FIG. 7, the apparatus for controlling the power supply described above further includes a filtering module 104. The filtering module 104 is connected with the current detecting module 101 and configured to filter the real-time current detected by the current detecting module 101, thereby filtering interference information.

In this embodiment, as shown in FIG. 7, the controlling module 102 includes a comparing unit 105 and a controlling unit 106. The comparing unit 105 is connected with the filtering module 104 and configured to compare the filtered real-time current with the preset current reference value, so as to generate a comparing signal. The controlling unit 106 is connected with the comparing unit 105 and configured to control the IGBT according to the comparing signal. Specifically, as shown in FIG. 7, the apparatus for controlling the power supply according to the present disclosure mainly includes a current sampling circuit, a filtering and voltage dividing circuit, a comparing circuit, a controlling chip and a power controlling circuit, in which the preset current reference value is set in the comparing circuit in advance. After the power supply is started, the current sampling circuit collects the current flowing through the IGBT, i.e. the current flowing through resistor R25 after the electric supply is rectified. Then, the filtering and voltage dividing circuit filters the interference information, and the filtered current information is compared with the preset current reference value I2 by the comparing circuit. Further, the controlling chip outputs the corresponding control signal according to the comparing result, and controls the IGBT via the power controlling circuit. The controlling module 102 may realize the control on the output power by setting different preset current reference values.

Therefore, embodiments of the present disclosure may realize the power control of the high-frequency heating device. The principle is that the controlling module may set or calculate different preset current reference values according to different powers. With this apparatus, the controlling module may control outputting different powers for heating, also the function of over-current protection may be realized and elements of the heating device may be protected because the maximum preset current reference value is set.

As shown in FIG. 6, the apparatus for controlling the power supply of the high-frequency heating device further includes a driving module 107. The driving module 107 is connected with the controlling unit 102 in the controlling module 102 and a G electrode of the IGBT respectively, and configured to generate a driving signal under a control of the controlling unit 106, for driving the IGBT to turn on and turn off.

In embodiments of the present disclosure, the controlling module determines whether the IGBT is turned off according to the preset duty ratio or turned off ahead of the preset turn-off time, by comparing the detected real-time current following through the IGBT with the preset current reference value. Compared with the conventional sequential control mode performing a software adjustment on the driving of the IGBT, resources of the controlling module may be saved greatly and real-time performance of the over-current protection on the IGBT may be enhanced. Further, compared with the control mode which adjusts the control signal of the IGBT by adopting the real-time value of the input voltage as the reference, the maximum current is reduced during the whole procedure and the requirements for the switching element is reduced.

With the apparatus for controlling the power supply of the high-frequency heating device according to embodiments of the present disclosure, the cut-off control of the maximum value may be performed on the current flowing through the switching element during each switching period, thereby reducing the maximum current during the operation of the switching element and reducing the requirements for the switching element. Moreover, the over-current protection may be effectively performed because of the preset current reference value, such that elements of the high-frequency heating device may be protected from being damaged. In addition, resources of the controller may be greatly saved, and real-time performance of the over-current protection of the switching device may be enhanced.

In addition, embodiments of the present disclosure further provide a high-frequency heating device including the apparatus for controlling the power supply described above. The high-frequency heating device may be a microwave oven, an induction cooker or other devices.

Any process or method described in a flow chart or described herein in other ways may be understood to include one or more modules, segments or portions of codes of executable instructions for achieving specific logical functions or steps in the process, and the scope of a preferred embodiment of the present disclosure includes other implementations, which should be understood by those skilled in the art.

The logic and/or steps described in other manners herein or shown in the flow chart, for example, a particular sequence table of executable instructions for realizing the logical function, may be specifically achieved in any computer readable medium to be used by the instruction execution system, device or equipment (such as the system based on computers, the system comprising processors or other systems capable of obtaining the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium comprise but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer readable storage medium, and the programs comprise one or a combination of the steps in the method embodiments of the present disclosure when run on a computer.

In addition, each function cell of the embodiments of the present disclosure may be integrated in a processing module, or these cells may be separate physical existence, or two or more cells are integrated in a processing module. The integrated module may be realized in a form of hardware or in a form of software function modules. When the integrated module is realized in a form of software function module and is sold or used as a standalone product, the integrated module may be stored in a computer readable storage medium.

The storage medium mentioned above may be read-only memories, magnetic disks or CD, etc.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from scope of the present disclosure.

What is claimed is:

1. A method for controlling a power supply of a high-frequency heating device, comprising:

controlling a switching element of the high-frequency heating device to operate according to a control signal with a preset duty ratio;

detecting a real-time current flowing through the switching element; and if the real-time current is greater than or equal to a preset current reference value, controlling the switching element to turn off, and controlling the switching element to turn on when a next turn-on window of the control signal comes and the real-time current is less than the preset current reference value;

if the real-time current is less than the preset current reference value, keeping the switching element turning on, controlling the switching element to turn off when a present turn-on window of the control signal ends, and controlling the switching element to turn on when the next turn-on window of the control signal comes and the real-time current is less than the preset current reference value.

2. The method according to claim 1, wherein the control signal is a PWM signal.

3. The method according to claim 1, wherein the switching element is an IGBT.

4. An apparatus for controlling a power supply of a high-frequency heating device, comprising:

a current detecting module, configured to detect a real-time current flowing through a switching element of the high-frequency heating device;

a controlling module, connected with the current detecting module and configured to control the switching element to operate according to a control signal with a preset duty ratio, to control the switching element to turn off if the real-time current is greater than or equal to a preset current reference value, and to control the switching element to turn on when a next turning-on window of the control signal comes and the real-time current is less than the preset current reference value;

wherein if the real-time current is less than the preset current reference value, the controlling module is further configured to control the switching element to keep turning on until a present turn-on window of the control signal ends, to control the switching element to turn off when the present turn-on window of the control signal ends, and to control the switching element to turn on when the next turn-on window of the control signal comes and the real-time current is less than the preset current reference value.

5. The apparatus according to claim 4, wherein the control signal is a PWM signal.

6. The apparatus according to claim 4, wherein the switching element is an IGBT.

7. The apparatus according to claim 6, further comprising:

a filtering module, connected with the current detecting module and configured to filter the real-time current detected by the current detecting module.

8. The apparatus according to claim 7, wherein the controlling module comprises:

a comparing unit, connected with the filtering module and configured to compare the filtered real-time current with the preset current reference value, so as to generate a comparing signal;

a controlling unit, connected with the comparing unit and configured to control the IGBT according to the comparing signal.

9. The apparatus according to claim 8, further comprising:

a driving module, connected with the controlling unit and a G electrode of the IGBT respectively and configured to generate a driving signal under a control of the controlling unit, for driving the IGBT to turn on and turn off.

10. A high-frequency heating device comprising the apparatus for controlling the power supply of the high-frequency heating device, the apparatus comprising:

a current detecting module, configured to detect a real-time current flowing through a switching element of the high-frequency heating device;

a controlling module, connected with the current detecting module and configured to control the switching element to operate according to a control signal with a preset duty ratio, to control the switching element to turn off if the real-time current is greater than or equal to a preset current reference value, and to control the switching element to turn on when a next turning-on window of the control signal comes and the real-time current is less than the preset current reference value;

wherein if the real-time current is less than the preset current reference value, the controlling module is further configured to control the switching element to keep turning on until a present turn-on window of the control signal ends, to control the switching element to turn off when the present turn-on window of the control signal ends, and to control the switching element to turn on when the next turn-on window of the control signal comes and the real-time current is less than the preset current reference value.

* * * * *